US009494170B2

(12) United States Patent
Hou

(10) Patent No.: US 9,494,170 B2
(45) Date of Patent: Nov. 15, 2016

(54) CLUTCHED HYDRAULIC SYSTEM FOR A REFUSE VEHICLE

(71) Applicant: Oshkosh Corporation, Oshkosh, WI (US)

(72) Inventor: Yanming Hou, Rochester, MN (US)

(73) Assignee: Oshkosh Corporation, Oshkosh, WI (US)

( * ) Notice: Subject to any disclaimer, the term of this patent is extended or adjusted under 35 U.S.C. 154(b) by 159 days.

(21) Appl. No.: 14/185,705

(22) Filed: Feb. 20, 2014

(65) Prior Publication Data

US 2015/0232269 A1 Aug. 20, 2015

(51) Int. Cl.

| | |
|---|---|
| ***F15B 11/042*** | (2006.01) |
| ***F15B 13/04*** | (2006.01) |
| ***B65F 3/00*** | (2006.01) |

(52) U.S. Cl.

CPC ..... *F15B 13/0401* (2013.01); *B65F 3/00* (2013.01); *F15B 11/0423* (2013.01); *F15B 2211/20553* (2013.01); *F15B 2211/20592* (2013.01); *F15B 2211/30565* (2013.01); *F15B 2211/3111* (2013.01); *F15B 2211/6051* (2013.01); *F15B 2211/633* (2013.01); *F15B 2211/6313* (2013.01); *F15B 2211/6336* (2013.01); *F15B 2211/6651* (2013.01); *F15B 2211/6652* (2013.01); *F15B 2211/7128* (2013.01); *F15B 2211/7142* (2013.01)

(58) Field of Classification Search

CPC ..... F04B 49/002; F15B 2211/75; F15B 2211/605; F15B 2211/20553; F15B 13/0417;F15B 13/0401; F15B 11/166; F15B 11/165; F16H 2045/002; B60K 25/02; B60K 2025/026

See application file for complete search history.

(56) References Cited

U.S. PATENT DOCUMENTS

| | | | | |
|---|---|---|---|---|
| 4,741,410 A * | 5/1988 | Tunmore | ..... | B60K 6/12 180/165 |
| 8,087,733 B2 * | 1/2012 | Fouquet | ..... | B60K 6/12 303/10 |
| 2011/0264335 A1 * | 10/2011 | Zhao | ..... | B66F 9/22 701/50 |

OTHER PUBLICATIONS

Chelsea 870 Series Ten bolt Powershift P.T.O., Sep. 2011, 2 pages.
Chelsea 890 Series New Powershift P.T.O. for Allison 3000/4000 Transmissions, Apr. 2013, 2 pages.
Chelsea Owner's Manual Power Take-Offs, Nov. 2011, 32 pages.

* cited by examiner

*Primary Examiner* — John K Fristoe, Jr.
*Assistant Examiner* — Michael Quandt
(74) *Attorney, Agent, or Firm* — Foley & Lardner LLP

(57) ABSTRACT

A hydraulic system for a vehicle includes a variable displacement pump configured to pressurize a fluid based on a pump stroke, a clutch, and a controller that is coupled to the variable displacement pump and the clutch. The clutch is positioned to selectively couple the variable displacement pump with an engine when engaged and selectively decouple the variable displacement pump from the engine when disengaged. The controller is configured to generate a first command signal to decrease the pump stroke and thereafter generate a second command signal to disengage the clutch.

15 Claims, 8 Drawing Sheets

CLUTCHED HYDRAULIC SYSTEM FOR A REFUSE VEHICLE

BACKGROUND

Hydraulic systems traditionally include a pressure source (e.g., a hydraulic pump), a hydraulic circuit through which the pressurized fluid is transported, and one or more devices (e.g., hydraulic cylinders, hydraulic motors, etc.) in which the pressure is used to do work. Flow of hydraulic fluid to the device may be controlled with a valve in the hydraulic circuit. The pressure source may be powered by the engine of the vehicle. At higher engine speeds, the pump speed increases, thereby causing wear on the bearings and pistons or vanes of the pressure source.

SUMMARY

One embodiment of the invention relates to a hydraulic system for a vehicle that includes a variable displacement pump configured to pressurize a fluid based on a pump stroke, a clutch, and a controller that is coupled to the variable displacement pump and the clutch. The clutch is positioned to selectively couple the variable displacement pump with an engine when engaged and selectively decouple the variable displacement pump from the engine when disengaged. The controller is configured to generate a first command signal to decrease the pump stroke and thereafter generate a second command signal to disengage the clutch.

Another embodiment of the invention relates to a refuse vehicle including an engine, a hydraulic system, a clutch, and a controller that is coupled to the hydraulic system and the clutch. The hydraulic system includes an actuator that is coupled to a variable displacement pump. The variable displacement pump is configured to pressurize a fluid based on a pump stroke. The clutch selectively couples the variable displacement pump to the engine. The controller is configured to engage the clutch when the refuse vehicle enters a collection mode and deactivate the hydraulic system before disengaging the clutch when the refuse vehicle enters a transport mode.

Yet another embodiment of the invention relates to a method of operating a hydraulic system for a vehicle that includes monitoring a speed of an engine, reducing a stroke of a variable displacement pump when the speed of the engine exceeds a threshold, and disengaging a clutch selectively coupling the variable displacement pump to the engine after reducing the stroke of the variable displacement pump. Disengaging the clutch after reducing the stroke of the variable displacement pump reduces wear on the clutch.

The invention is capable of other embodiments and of being carried out in various ways. Alternative exemplary embodiments relate to other features and combinations of features as may be recited in the claims.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Figure 1A:
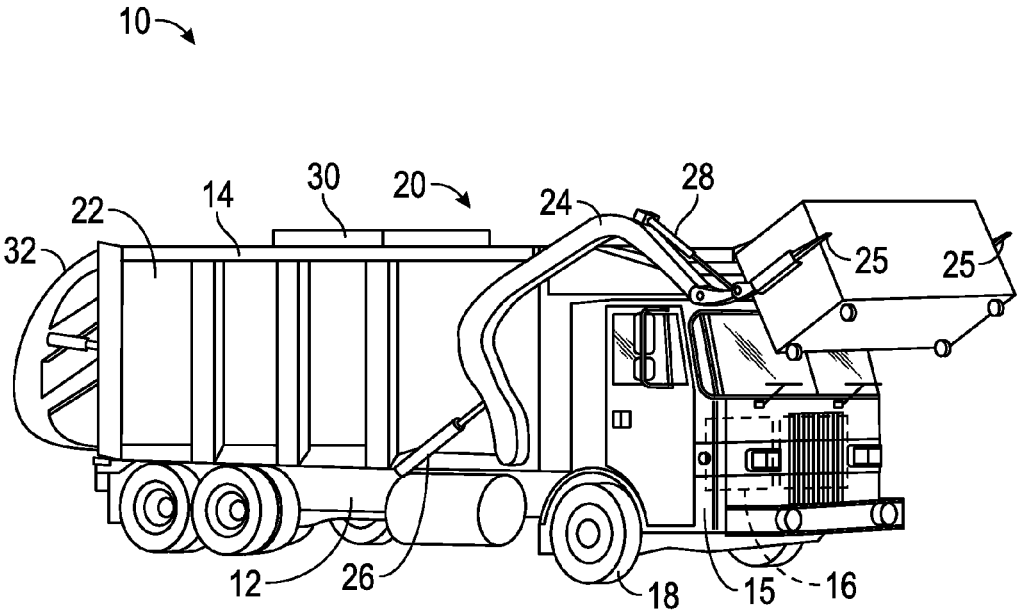
FIGS. 1A-1E are isometric views of refuse vehicles that include hydraulic systems, according to various alternative embodiments.

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Referring to FIGS. 1A-1E, a vehicle, shown as refuse truck 10 (e.g., garbage truck, waste collection truck, sanitation truck, etc.), includes a chassis, shown as frame 12, and a body, shown as body 14. In one embodiment, body 14 is coupled to frame 12. Body 14 includes an operator's compartment, shown as cab 15. Refuse truck 10 further includes an engine 16 mounted at the front of the frame 12. In one embodiment, engine 16 is an internal combustion engine. Engine 16 provides power to wheels 18 and to other systems of the vehicle. Engine 16 may be configured to utilize a variety of fuels including gasoline, diesel, bio-diesel, ethanol, natural gas, or still other fuels. According to other exemplary embodiments, engine 16 is another type of device. By way of example, engine 16 may include one or more electric motors that power the systems of refuse truck 10. The electric motor may consume electrical power from an on-board storage device (e.g., batteries, ultra-capacitors, etc.), from an on-board generator (e.g., an internal combustion engine, etc.), or an external power source (e.g., overhead power lines, etc.).

Refuse truck 10 is configured to collect and transport refuse. In one embodiment, refuse truck 10 collects and transports refuse from waste receptacles (e.g., cans, bins, containers, etc.) from a collection area, such as on the side of the road or in an alley. Body 14 includes sidewalls 22 that at least partially define a collection chamber, shown as compartment 20 (e.g., hopper, etc.), according to an exemplary embodiment. As shown in FIGS. 1A-1E, compartment 20 is positioned in the rear of refuse truck 10. Refuse may be deposited in the compartment 20 for transport to a waste disposal site (e.g., a landfill, a recycling facility, etc.).

According to the exemplary embodiment shown in FIG. 1A, refuse truck 10 is a front-loading truck. As shown in FIG. 1A, refuse truck 10 includes moveable arms 24 coupled to frame 12 on either side of cab 15. Interface members, shown as forks 25, are coupled to arms 24 and are configured to engage a refuse container, according to an exemplary embodiment. After forks 25 have engaged a refuse container, arms 24 may be rotated about an axis by a set of actuators, shown as hydraulic cylinders 26. Rotation of arms 24 lifts the refuse container over cab 15 of refuse truck 10. After rotating arms 24, refuse truck 10 rotates forks 25 with another set of actuators, shown as hydraulic cylinders 28, to tip the refuse out of the container and into compartment 20. Forks 25 and arms 24 are then articulated to return the empty container to the ground. After receiving the refuse, the top of compartment 20 may be closed with a top door 30 to prevent refuse from escaping out of compartment 20 (e.g., during transportation of the refuse to a waste disposal site, etc.).

Figure 1B:
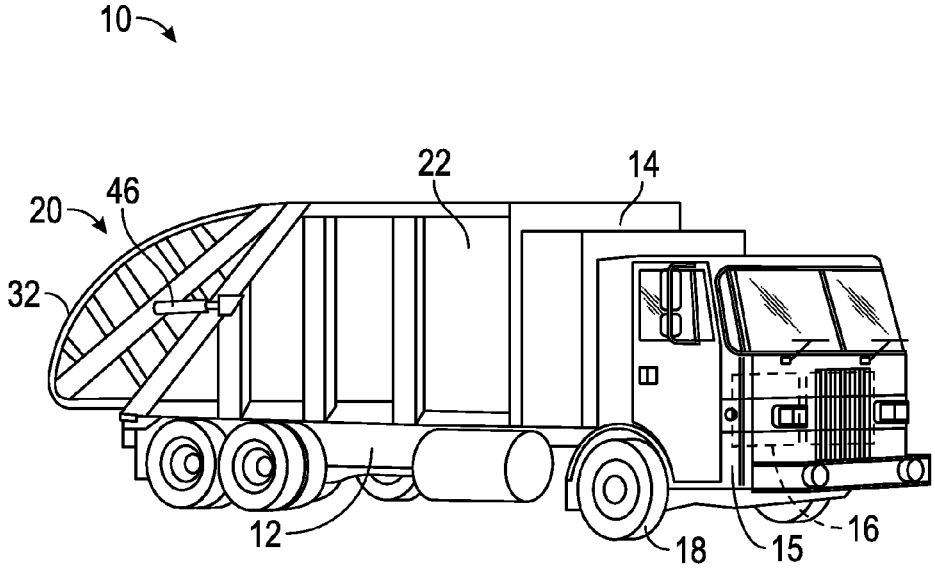

According to the exemplary embodiment shown in FIG. 1B, refuse truck 10 is a rear-loading truck. In one embodiment, refuse containers are emptied into the back of the compartment 20 through an opening in a tailgate 32. The refuse may be emptied into compartment 20 manually or with a mechanical system (e.g., arms similar to arms 24 described above, a chain or cable tipping system, etc.).

Figure 1C:
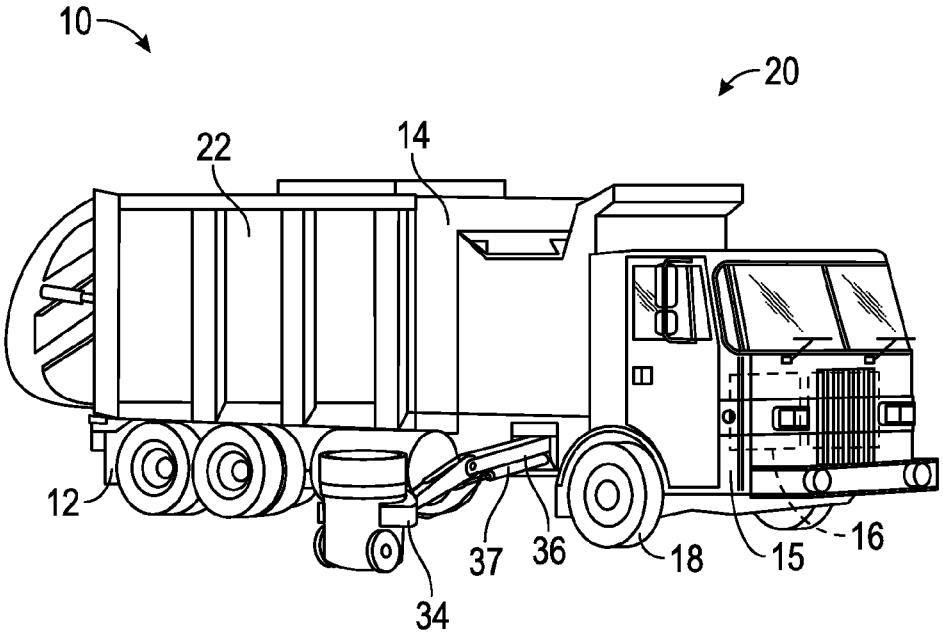
Figure 1D:
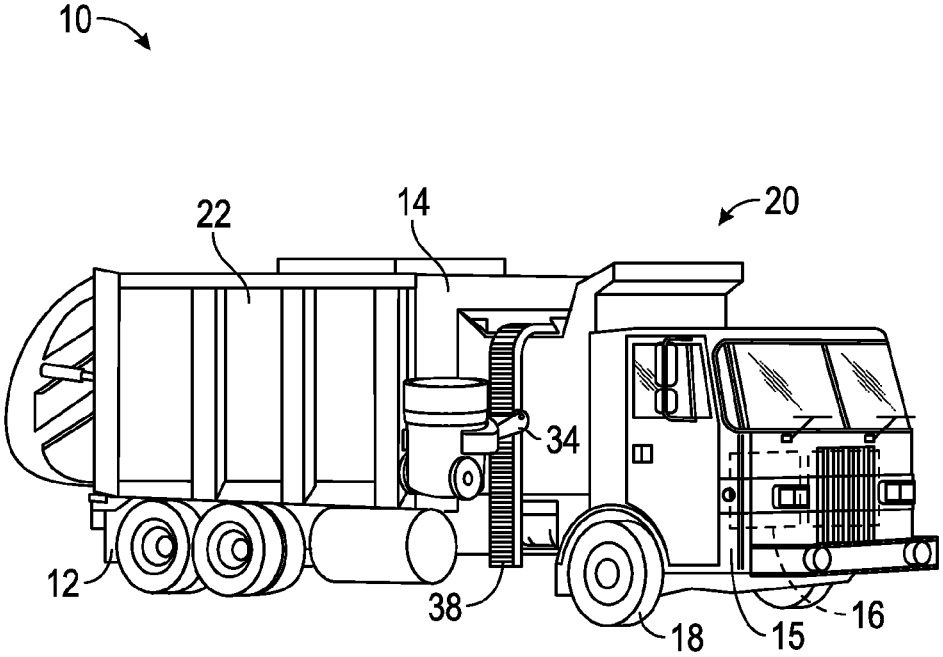

According to the exemplary embodiments shown in FIGS. 1C and 1D, refuse truck 10 is a side-loading truck. As shown in FIGS. 1C and 1D, refuse truck 10 includes a grabber 34 configured to interface with the refuse container. As shown in FIG. 1C, grabber 34 is coupled to an end of an arm 36. Arm 36 is moveable to raise and lower grabber 34, according to an exemplary embodiment. As shown in FIG. 1C, an actuator, shown as hydraulic cylinder 37, is positioned to rotate arm 36 relative to frame 12. Arm 36 may be moveable in multiple directions (e.g., up/down, left/right, in/out, rotation, etc.) to facilitate grabbing a refuse container. According to an alternative embodiment shown in FIG. 1D, grabber 34 is movably coupled to a track 38. After grabber 34 has engaged a refuse container, grabber 34 is pulled upward to lift the refuse container over one of the sidewalls 22 and tip the refuse out of the container and into compartment 20. In one embodiment, loose refuse falls into compartment 20 through an opening in the top thereof. Grabber 34 is then moved back to a ground level to return the empty container to the ground. After receiving the refuse, a door may be closed to prevent refuse from escaping through the top of the compartment 20.

Figure 1E:
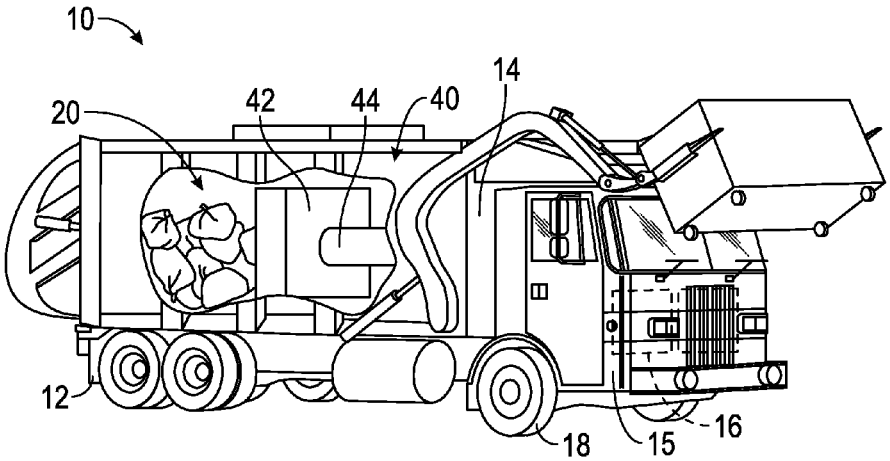

According to an exemplary embodiment shown in FIG. 1E, the refuse truck 10 includes a packer 40 (e.g., press, compactor, etc.) disposed within the compartment 20. Packer 40 is configured to compact the refuse within compartment 20, according to an exemplary embodiment. Packer 40 may include a hydraulic system. As shown in FIG. 1E, packer 40 includes a ram 42 driven by an actuator, shown as hydraulic cylinder 44. Hydraulic cylinder 44 forces ram 42 into the refuse in compartment 20, compressing the refuse against an interior wall of compartment 20. Packer 40 may compact the refuse towards the front of compartment 20 (e.g., for a rear-loading truck) or towards the back of compartment 20 (e.g., for a front-loading or side-loading truck). According to other exemplary embodiments, packer 40 includes another mechanism (e.g., a screw mechanism, etc.) configured to otherwise process (e.g., compact, shred, etc.) the refuse within compartment 20.

Referring still to FIGS. 1A-1E, the portion of body 14 forming the compartment 20 may be rotated or tipped to empty refuse from compartment 20 into another receptacle or collection area. According to an exemplary embodiment, body 14 is tipped backwards (e.g., towards the tailgate 32) with an actuator (e.g., a lift cylinder, a dump cylinder, a raise cylinder, etc.). In one embodiment, the actuator is a hydraulic component (e.g., a hydraulic cylinder, etc.). According to the exemplary embodiment shown in FIG. 1B, tailgate 32 is rotatably coupled to body 14. In one embodiment, tailgate 32 and body 14 are simultaneously rotated to empty refuse from compartment 20. As shown in FIG. 1B, an actuator, shown as hydraulic cylinder 46, is used to rotate tailgate 32. In other embodiments, body 14 remains stationary while tailgate 32 is rotated to empty refuse from compartment 20. The refuse may be pushed out from compartment 20 with an actuator (e.g., a ram of a packer, etc.) or may be otherwise removed (e.g., poured out, etc.).

Figure 2:
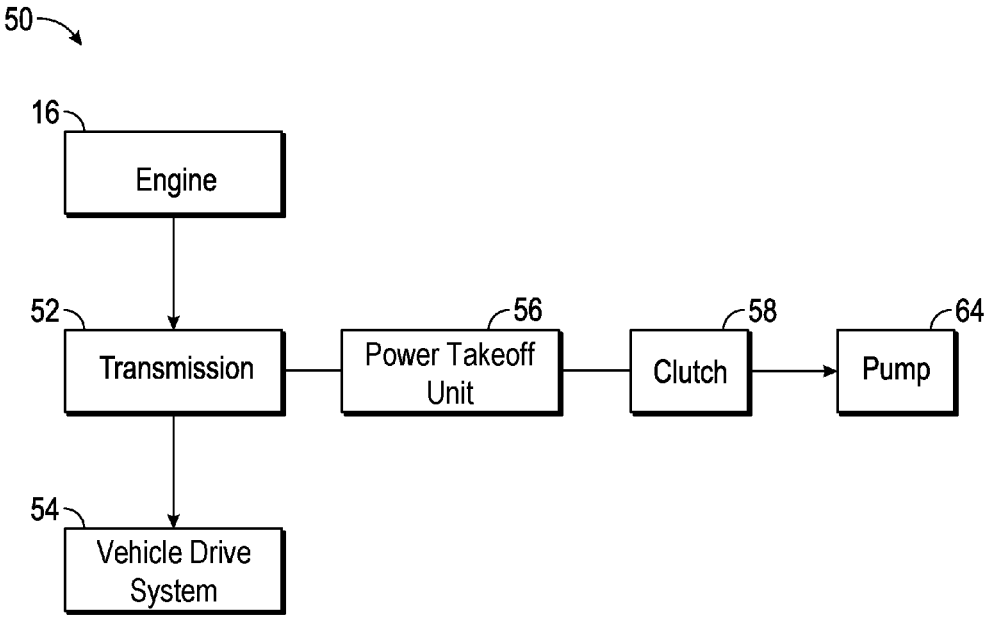
FIG. 2 is a power flow diagram for a vehicle having a hydraulic system that is selectively coupled to a transmission with a clutch, according to an exemplary embodiment.

Referring next to FIG. 2, a power system 50 for a vehicle (e.g., a refuse truck) includes engine 16 and a power transfer device, shown as transmission 52. As shown in FIG. 2, engine 16 is coupled to transmission 52. In one embodiment, engine 16 produces mechanical power (e.g., due to a combustion reaction) that flows into transmission 52. According to the embodiment shown in FIG. 2, power system 50 includes a vehicle drive system 54 that is coupled to transmission 52. In one embodiment, at least a portion of the mechanical power produced by engine 16 flows through transmission 52 and into vehicle drive system 54. By way of example, vehicle drive system 54 may include tractive elements (e.g., wheels and tires, etc.) that engage a ground surface to move the vehicle. Vehicle drive system 54 may also include drive shafts, differentials, and other components coupling transmission 52 with a ground surface to move the vehicle. In one embodiment, energy (e.g., mechanical energy) flows along a first power path defined from engine 16, through transmission 52, and to vehicle drive system 54.

Referring still to FIG. 2, power system 50 includes a power takeoff unit, shown as power takeoff unit 56 that is coupled to transmission 52. In one embodiment, transmission 52 and power takeoff unit 56 include mating gears that are in meshing engagement. A portion of the energy provided to transmission 52 flows through the mating gears and into power takeoff unit 56, according to an exemplary embodiment. In one embodiment, the mating gears have the same effective diameter. In other embodiments, at least one of the mating gears has a larger diameter, thereby providing a gear reduction or a torque multiplication and increasing or decreasing the gear speed.

As shown in FIG. 2, power takeoff unit 56 is selectively coupled to a prime mover, shown as first hydraulic pump 64, with a clutch 58. According to an alternative embodiment, power takeoff unit 56 includes clutch 58 (e.g., as a hot shift PTO). In one embodiment, clutch 58 includes a plurality of clutch discs. When clutch 58 is engaged, an actuator forces the plurality of clutch discs into contact with one another, which couples an output of transmission 52 with first hydraulic pump 64. In one embodiment, the actuator includes a solenoid that is electronically actuated according to a clutch control strategy. When clutch 58 is disengaged, first hydraulic pump 64 is not coupled to (i.e., isolated from) the output of transmission 52. Relative movement between the clutch discs or movement between the clutch discs and another component of power takeoff unit 56 may be used to decouple first hydraulic pump 64 from transmission 52.

In one embodiment, energy flows along a second power path defined from engine 16, through transmission 52 and power takeoff unit 56, and into first hydraulic pump 64 when clutch 58 is engaged. When clutch 58 is disengaged, energy flows from engine 16, through transmission 52 and into power takeoff unit 56. Clutch 58 selectively couples first hydraulic pump 64 to engine 16, according to an exemplary embodiment. In one embodiment, energy along the first flow path is used to drive the vehicle, whereas energy along the second flow path is used to power at least one of first hydraulic pump 64, a hydraulic system for the vehicle, and still other vehicle subsystems. Energy may flow along the first flow path during normal operation of the vehicle and selectively flow along the second flow path. By way of example, clutch 58 may be engaged such that energy flows along the second flow path when operation of first hydraulic pump 64 is required to perform a particular task. When operation of first hydraulic pump 64 is not required (e.g., while the vehicle is traveling down a roadway at traffic speeds), clutch 58 may be selectively disengaged, thereby conserving energy relative to traditional systems having hydraulic pumps that are constantly coupled to the output of an engine. Selectively disengaging first hydraulic pump 64 increases the working life of the components therein (e.g., bearings, pistons, etc.). According to an exemplary embodiment, first hydraulic pump 64 is selectively disengaged for engine speeds above a threshold, thereby reducing the additional wear associated with operating first hydraulic pump 64 at elevated speeds.

Figure 3:
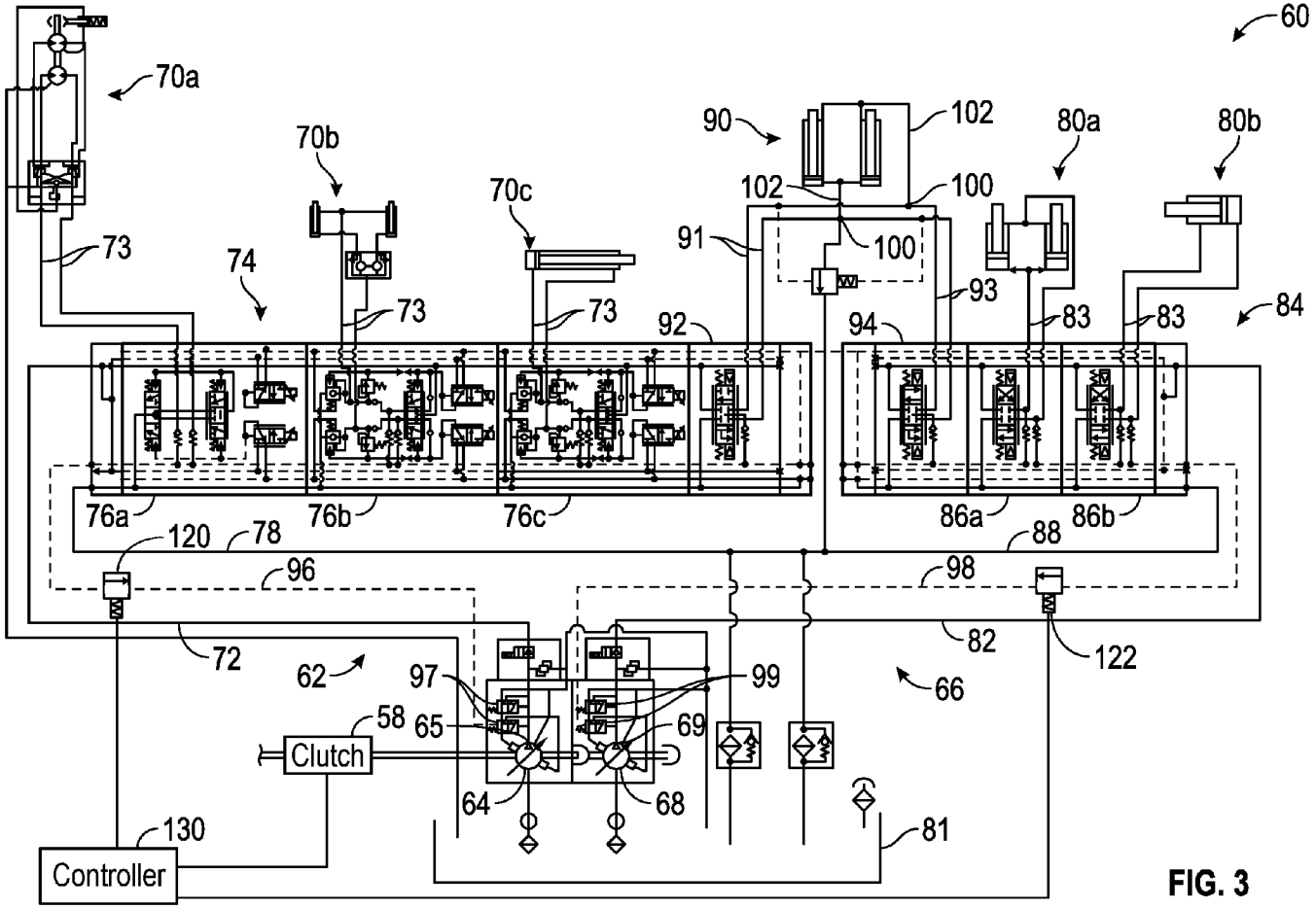
FIG. 3 is a schematic diagram of a hydraulic system for a vehicle, according to an exemplary embodiment.
Figure 4:
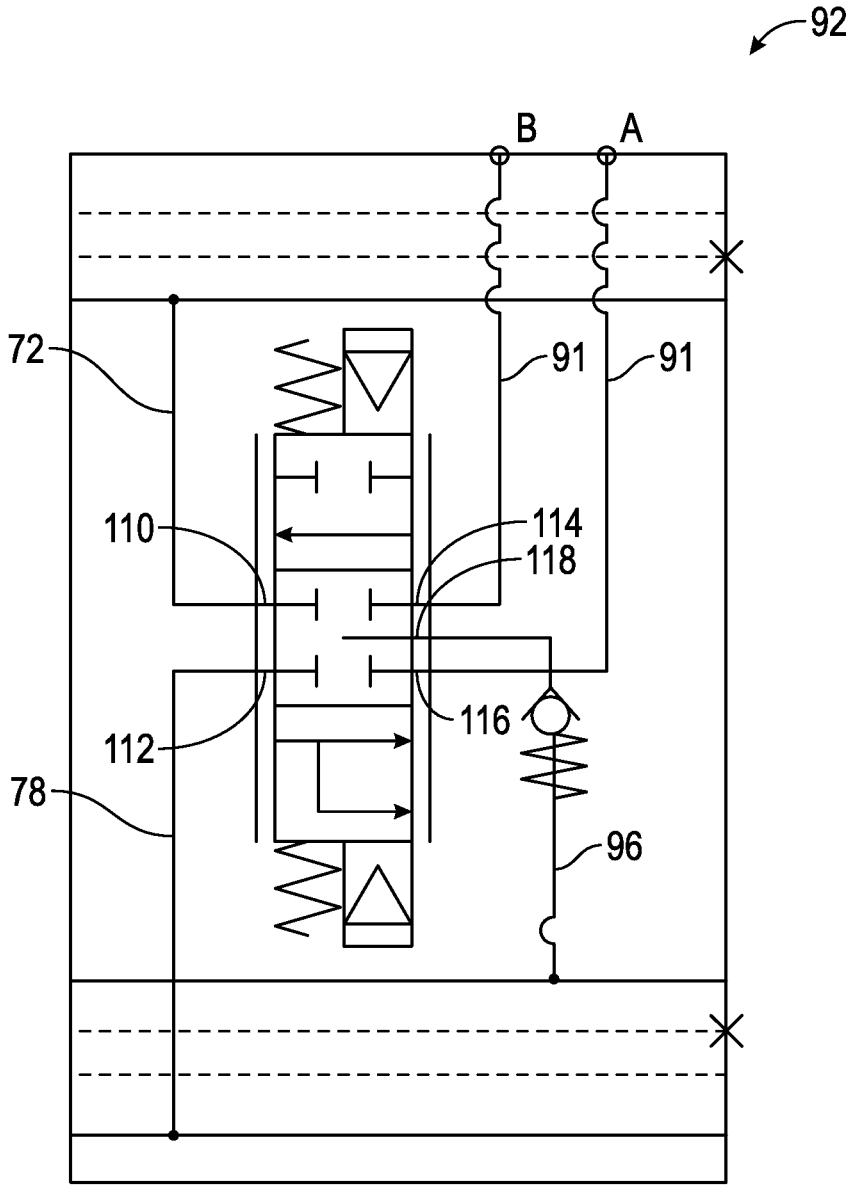
FIG. 4 is schematic diagram of a control valve for a hydraulic system, according to an exemplary embodiment.

Referring next to FIGS. 3-4, a hydraulic system 60 is configured to facilitate various operations of the vehicle. As shown in FIG. 3, hydraulic system 60 includes a first hydraulic circuit 62 including first hydraulic pump 64 and a second hydraulic circuit 66 including a second prime mover, shown as a second hydraulic pump 68. In other embodiments, hydraulic system 60 includes only one hydraulic circuit (e.g., first hydraulic circuit 62, second hydraulic circuit 66, etc.). As shown in FIG. 3, hydraulic system 60 includes two prime movers. In other embodiments, hydraulic system 60 includes more or fewer prime movers. According to the exemplary embodiment shown in FIG. 3, first hydraulic pump 64 and second hydraulic pump 68 are both coupled to clutch 58 via a common shaft. Clutch 58 selectively couples first hydraulic pump 64 and second hydraulic pump 68 to a prime mover of the vehicle, according to an exemplary embodiment. In other embodiments, first hydraulic pump 64 and second hydraulic pump 68 are both otherwise coupled to clutch 58 (e.g., with intermediate gearing, etc.). In still other embodiments, first hydraulic pump 64 and second hydraulic pump 68 are selectively coupled to the engine of a vehicle with separate clutches. The separate clutches may be engaged and disengaged together or independently. In one embodiment, the separate clutches are engaged and disengaged together according to the clutch control strategy disclosed herein.

According to the exemplary embodiment shown in FIG. 3, first hydraulic pump 64 and second hydraulic pump 68 draw hydraulic fluid (e.g., hydraulic oil) from a common reservoir 81 (e.g., tank). In other embodiments, first hydraulic pump 64 and second hydraulic pump 68 draw hydraulic fluid from separate reservoirs. As shown in FIG. 3, first hydraulic pump 64 and second hydraulic pump 68 are variable displacement hydraulic pumps and have a pump stroke that is variable. First hydraulic pump 64 and second hydraulic pump 68 are configured to pressurize hydraulic fluid based on the pump stroke. According to an exemplary embodiment, first hydraulic pump 64 and second hydraulic pump 68 are axial piston pumps and include a swash plate. The pump stroke varies based on the orientation of the swash plate. In one embodiment, the pump stroke of first hydraulic pump 64 and second hydraulic pump 68 varies based on an angle of the swash plate (e.g., relative to an axis along which the pistons move within the axial piston pumps). By way of example, the pump stroke may be zero where the angle of the swash plate equal to zero. The pump stroke may increase as the angle of the swash plate increases.

First hydraulic pump 64 includes a hydraulic flow output 65, and second hydraulic pump 68 includes a hydraulic flow output 69. As shown in FIG. 3, hydraulic flow output 65 of first hydraulic pump 64 is coupled to a plurality of actuators, shown as actuators 70*a*-70*c*, and hydraulic flow output 69 of second hydraulic pump 68 is coupled to a plurality of actuators, shown as actuators 80*a*-80*b*. Actuators 70*a*-70*c* and actuators 80*a*-80*b* may include linear actuators, rotational actuators, or still other types of devices. As shown in FIG. 3, actuator 70*a* is positioned to perform a raise or dump operation for a refuse vehicle, actuator 70*b* is positioned to operate a grabber of a refuse vehicle, actuator 70*c* is positioned to perform a reach operation of a refuse vehicle, actuator 80*a* is positioned to move a tailgate of a refuse vehicle, and actuator 80*b* is positions to move a top door of a refuse vehicle (e.g., a door that closes a refuse collection chamber to prevent debris from escaping during transport). In other embodiments, hydraulic flow output 65 of first hydraulic pump 64 and hydraulic flow output 69 of second hydraulic pump 68 are coupled to more or fewer actuators to perform various operations for a refuse vehicle. In still other embodiments, a different type of vehicle (e.g., a fire truck, a lift device, etc.) includes hydraulic pumps coupled to actuators that perform still other operations (e.g., to raise and lower a ladder of a fire truck, to elevate or extend a boom section of a lift device, etc.).

As shown in FIG. 3, actuators 70*a*-70*c* are coupled to hydraulic flow output 65 of first hydraulic pump 64 with a first pressure line 72 (e.g., high pressure line), and actuators 80*a*-80*b* are coupled to hydraulic flow output 69 of second hydraulic pump 68 with a second pressure line 82 (e.g., high pressure line). According to an exemplary embodiment, a plurality of main valves are disposed along first pressure line 72 and second pressure line 82. As shown in FIG. 3, hydraulic system 60 includes a first valve block 74 that includes a plurality of main valves, shown as valves 76*a*-76*c*, and a second valve block 84 that includes a plurality of main valves, shown as valves 86*a*-86*b*. Valves 76*a*-76*c* are configured to control the flow of pressurized fluid from first hydraulic pump 64 to actuators 70*a*-70*c*, respectively, and valves 86*a*-86*b* are configured to control the flow of pressurized fluid from second hydraulic pump 68 to actuators 80*a*-80*b*, respectively. According to an exemplary embodiment, pressurized fluid flows from hydraulic flow output 65, along first pressure line 72 to actuators 70*a*-70*c*, and back to reservoir 81 via a first return line 78 (e.g., low pressure line). Pressurized fluid also flows from hydraulic flow output 69, along second pressure line 82 to actuators 80*a*-80*b*, and back to reservoir 81 via a second return line 88.

According to an exemplary embodiment, the fluid within first pressure line 72 has a pressure that varies between 500 PSI and 1,500 PSI during operation of actuators 70*a*-70*c*. By way of example, the fluid within first pressure line 72 may have a pressure of 1,000 PSI during operation of actuators 70*a*-70*c*. According to an exemplary embodiment, the fluid within second pressure line 82 has a pressure that varies between 1,500 PSI and 2,500 PSI during operation of actuators 80*a*-80*b*. By way of example, the fluid within second pressure line 82 may have a pressure of 2,000 PSI during operation of actuators 80*a*-80*b*.

According to an exemplary embodiment, hydraulic system 60 further includes a main actuator, shown as actuator 90, that is coupled to both first hydraulic circuit 62 and second hydraulic circuit 66. Actuator 90 is coupled to first pressure line 72 of first hydraulic circuit 62 by a main valve, shown as valve 92, and is coupled to second pressure line 82 of second hydraulic circuit 66 by another main valve, shown as valve 94. According to the exemplary embodiment shown in FIG. 3, valve 92 is provided as a part of first valve block 74 and valve 94 is provided as part of the second valve block 84. Actuator 90 may be configured to oppose a load force that exceeds the maximum output capabilities (e.g., maximum pressure, maximum flow rate, etc.) of either first hydraulic pump 64 or second hydraulic pump 68. By way of example, actuator 90 may be a high volume actuator. In one embodiment, actuator 90 is a hydraulic cylinder configured to actuate a packer for a refuse vehicle, actuator 90 providing a load force to the refuse during compaction.

Referring to the exemplary embodiment shown in FIG. 3, first hydraulic pump 64 and second hydraulic pump 68 are load sensing, pressure compensating variable displacement hydraulic pumps. Hydraulic system 60 includes a load sensing system configured to monitor the load on the hydraulic system. The load sensing system provides independent feedback of the load on the actuators to first hydraulic pump 64 and second hydraulic pump 68. As shown in FIG. 3, a first load sensing line 96 couples valves 76*a*-76*c* and valve 92 to feedback valves (e.g., flow compensator valves, pressure compensator valves, etc.), shown as valves 97 of first hydraulic pump 64. A second load sensing line 98 couples valves 86*a*-86*b* and valve 94 to feedback valve, shown as valves 99 of second hydraulic pump 68. First load sensing line 96 and second load sensing line 98 provide feedback passages from first pressure line 72 and second pressure line 82 back to first hydraulic pump 64 and second hydraulic pump 68, respectively. Valves 97 and valves 99 may control the output of first hydraulic pump 64 and second hydraulic pump 68. According to an exemplary embodiment, valves 97 are positioned to control the orientation of the swash plate of first hydraulic pump 64, and valves 99 are positioned to control the orientation of the swash plate of second hydraulic pump 68. By way of example, valves 97 and valves 99 may control the orientation of the swash plate as a function of the pressures within first load sensing line 96 and second load sensing line 98. Where first load sensing line 96 and second load sensing line 98 are pressurized, valves 97 and valves 99 may facilitate stroking first hydraulic pump 64 and second hydraulic pump 68.

In one embodiment, closing a valve (e.g., valve 76*a*, valve 76*b*, valve 76*c*, valve 86*a*, valve 86*b*, valve 92, valve 94, etc.) disposed between an actuator (e.g., actuator 70*a*, actuator 70*b*, actuator 70*c*, actuator 80*a*, actuator 80*b*, actuator 90, etc.) and at least one of first hydraulic pump 64 and second hydraulic pump 68 reduces the pressure in at least one of first load sensing line 96 and second load sensing line 98. Where the pressure in first load sensing line 96 and second load sensing line 98 is reduced, valves 97 and valves 99 may facilitate reducing the stroke of first hydraulic pump 64 and second hydraulic pump 68, respectively. Vents (e.g., vent valves, etc.) may be disposed along first load sensing line 96 and second load sensing line 98 to facilitate reducing the pressures therein. By way of example, at least a portion of the main valves may be electronically controlled (e.g., with solenoids, etc.), and command signals may open vents and actuate the main valves according to a coordinated control strategy. If an increased load is experienced in the high pressure line, it is sensed by the respective hydraulic pump via the load sensing line. The hydraulic pump output is then increased to compensate for the increased load.

According to an exemplary embodiment, first load sensing line 96 is coupled to branches 73 of first pressure line 72 and second load sensing line 98 is coupled to the branches 83 of the second pressure line 82. In one embodiment, first hydraulic pump 64 is isolated from second hydraulic pump 68. A fluctuation in the load on any of actuators 70*a*-*c* as is sensed by first load sensing line 96, and the output of first hydraulic pump 64 is varied accordingly. A fluctuation in the load on any of the actuators 80*a*-*b* as is sensed by first load sensing line 96, and the output of second hydraulic pump 68 is varied accordingly. In either scenario, first hydraulic pump 64 and second hydraulic pump 68 are free to operate independent of each other. By way of example, if one of actuators 80*a*-*b* encounters an elevated load and requires additional hydraulic fluid at a high pressure (e.g., approximately 2000 PSI), only the output of second hydraulic pump 68 is increased. First hydraulic pump 64 is free to continue operating with an output tuned to the requirements of actuators 70*a*-*c* or other components of first hydraulic circuit 62. In one embodiment, first hydraulic circuit 62 operates a lower pressure (e.g. approximately 1000 PSI) than second hydraulic circuit 66. When the output of second hydraulic pump 68 increases to accommodate additional load, first hydraulic pump 64 continues normal operation, according to an exemplary embodiment, without trying to match the output of second hydraulic pump 68, thereby improving the efficiency of hydraulic system 60 by eliminating the waste heat that would be otherwise generated by unnecessarily increasing the output of first hydraulic pump 64.

In one embodiment, the functions of hydraulic system 60 performed by actuators 70*a*-*c* and actuators 80*a*-*b* are powered by one of first hydraulic pump 64 or second hydraulic pump 68. Only one of the actuators in each of first hydraulic circuit 62 and second hydraulic circuit 66 may be operated at any given time during normal operation of a refuse truck. First hydraulic pump 64 may be configured to have a maximum output that is sufficient to operate each of actuators 70*a*-*c* in the first hydraulic circuit 62 simultaneously and second hydraulic pump 68 may be configured to have a maximum output that is sufficient to operate each of actuators 80*a*-*b* in the second hydraulic circuit 66 simultaneously. According to an alternative embodiment, first hydraulic pump 64 is configured to have a maximum output that is sufficient to operate only one component in the first hydraulic circuit 62 or second hydraulic pump 68 is configured to have a maximum output that is sufficient to operate only one component in second hydraulic circuit 66, or both first hydraulic pump 64 and second hydraulic pump 68 have maximum outputs sufficient to operate only one component of first hydraulic circuit 62 and second hydraulic circuit 66, respectively.

Actuator 90 may require a flow rate that exceeds the maximum flow rate of either first hydraulic pump 64 or second hydraulic pump 68 on its own. Actuator 90 is coupled to both first hydraulic circuit 62 and second hydraulic circuit 66 such that the outputs of first hydraulic pump 64 and second hydraulic pump 68 are collectively applied to power actuator 90 (e.g., to provide a sufficient flow rate to the actuator 90). According to an exemplary embodiment, actuator 90 is coupled to first hydraulic circuit 62 via branches 91 and to second hydraulic circuit 66 via branches 93. Unions 100 are provided between valve 92, valve 94, and actuator 90, with each union 100 having an inlet for branch 91 of first pressure line 72 and branch 93 of second pressure line 82. Unions 100 each include an outlet coupled to the actuator 90 via a common pressure line 102, according to an exemplary embodiment.

As shown in FIG. 4, valve 92 is a bi-directional control valve that includes a first port 110 coupled to first pressure line 72, a second port 112 coupled to first return line 78, a third port 114 coupled to branch 91, and a fourth port 116 coupled to another branch 91. According to an exemplary embodiment, actuator 90 is a linear actuator with an extension chamber and a compression chamber. Valve 92 includes a movable element that may be actuated (e.g., with a solenoid, etc.) to direct pressurized fluid from first pressure line 72 to branches 91 and direct fluid from another branch 91 to first return line 78. One of branches 91 is coupled to the extension chamber of the actuator 90 while the other branch 91 is coupled to the compression chamber of the actuator 90, according to an exemplary embodiment. The movable element of valve 92 may also be actuated to a neutral position. In one embodiment, valve 92 is disengaged when the movable element is actuated into the neutral position. In the neutral position, the movable element may be configured to limit flow from first hydraulic pump 64 to actuator 90 and first load sensing line 96. First load sensing line 96 is coupled to valve 92 at a fifth port 118, according to an exemplary embodiment. At least one of valves 76*a*-76*c*, valves 86*a*-86*b*, and valve 94 may have similar ports and selectively couple the hydraulic pumps, pressure lines, load sensing lines, and actuators to perform various tasks.

The load from actuator 90 in first pressure line 72 is sensed by first load sensing line 96 independently relative to the load from actuator 90 in second pressure line 82, which is sensed by second load sensing line 98. By joining first pressure line 72 and second pressure line 82 at unions 100 downstream of valve 92, valve 94, first load sensing line 96, and second load sensing line 98, respectively, first pressure line 72 and second pressure line 82 are isolated from each other. The load from actuator 90 on first hydraulic circuit 62 and second hydraulic circuit 66 is therefore sensed independently for first hydraulic pump 64 and second hydraulic pump 68, minimizing cross-talk between first hydraulic pump 64 and second hydraulic pump 68. The change in output of either first hydraulic pump 64 or second hydraulic pump 68 will not result in a change in output for the other pump, which would otherwise occur where two pumps may attempt to compensate for the varying output in a shared pressure line as sensed by a shared load sensing line.

Referring still to the exemplary embodiment shown in FIG. 3, a first load valve, shown as valve 120, is disposed along first load sensing line 96, and a second load valve, shown as valve 122 is disposed along second load sensing line 98. In one embodiment, valve 120 and valve 122 each include a moveable element configured to selectively limit flow from (e.g., limit hydraulic flow, reduce or eliminate fluid communication between, etc.) valves 76*a*-76*c*, valves 86*a*-86*b*, valve 92, and valve 94 to valves 97 and valves 99. By way of example, valve 120 and valve 122 may selectively limit flow when disengaged and selectively allow flow when engaged.

Referring still to the exemplary embodiment shown in FIG. 3, a controller 130 is configured to facilitate operation of various components according to predetermined control strategies. As shown in FIG. 3, controller 130 is coupled to clutch 58, valve 120, and valve 122. In another embodiment, controller 130 is coupled to clutch 58 and at least one of valves 76*a*-76*c*, valves 86*a*-86*b*, valve 92, and valve 94. Controller 130 is configured to engage and disengage clutch 58 according to a clutch control strategy, according to an exemplary embodiment. Controller 130 may also engage and disengaged at least one of valve 120, valve 122, valves 76*a*-76*c*, valves 86*a*-86*b*, valve 92, and valve 94 according to a valve control strategy.

According to an exemplary embodiment, controller 130 is configured to generate a first command signal to decrease the stroke of at least one of first hydraulic pump 64 and second hydraulic pump 68. In one embodiment, first hydraulic pump 64 and second hydraulic pump 68 each include a swash plate that is movable between a stroked position and a destroked position. According to the exemplary embodiment shown in FIG. 3, valves 97 and valves 99 are positioned to facilitate movement of the swash plates between the stroked positions and the destroked positions. In one embodiment, valves 97 and valves 99 include resilient members (e.g., a spring) configured to bias the swash plates in the destroked positions (e.g., by biasing movable elements of valve 97 and valve 99 into positions where a hydraulic circuit actuates the swash plates into the destroked positions, etc.). Pressure from fluid within first load sensing line 96 and second load sensing line 98 may overcome the resilient members to actuate the swash plates into the stroked positions (e.g., by actuating movable elements of valve 97 and valve 99 into positions where a hydraulic circuit actuates the swash plates into the stroked positions, etc.). In another embodiment, the swash plates of first hydraulic pump 64 and second hydraulic pump 68 are biased into a destroked positions by resilient members positioned to apply biasing forces, pressure from fluid within first load sensing line 96 and second load sensing line 98 overcoming the biasing forces to actuate the swash plates into the stroked positions. According to still another embodiment, the first command signal is received by one or more components that otherwise decrease the pump stroke of at least one of first hydraulic pump 64 and second hydraulic pump 68.

According to an exemplary embodiment, the first command signal disengages a valve to reduce the pressure within at least one of first load sensing line 96 and second load sensing line 98. By way of example, the first command signal may be received by an actuator (e.g., a solenoid) to disengage at least one of valve 120, valve 122, valves 76*a*-76*c*, valves 86*a*-86*b*, valve 92, and valve 94. The swash plates are actuated into the destroked positions by the decrease in pressure within at least one of first load sensing line 96 and second load sensing line 98, according to an exemplary embodiment. In one embodiment, the first command signal includes a plurality of electronic pulses configured to engage or disengage a plurality of valves such that the first command signal simultaneously or successively engages or disengages multiple valves to destroke at least one of first hydraulic pump 64 and second hydraulic pump 68. In one embodiment, the first command signal disengages valve 120 and at least one of valves 76*a*-76*c*. Disengaging valve 120 in addition to at least one of valves 76*a*-76*c* may further reduce the likelihood of pressurized fluid flow passing through first load sensing line 96, thereby reducing the risk of failing to destroke first hydraulic pump 64.

According to an alternative embodiment, actuators are coupled to the swash plates of first hydraulic pump 64 and second hydraulic pump 68. The actuators may move the swash plates between the stroked positions and the destroked positions. In one embodiment, controller 130 is configured to generate the first command signal, which engages an actuator to move the swash plate of at least one of first hydraulic pump 64 and second hydraulic pump 68 into the destroked position, thereby decreasing the pump stroke.

Controller 130 is configured to generate the first command signal and thereafter generate a second command signal to disengage clutch 58. In one embodiment, clutch 58 includes at least one engagement member (e.g., clutch disc) and an actuator (e.g., a solenoid) configured to selectively trigger the engagement member. Controller 130 is configured to electronically control the actuator to selectively engage and disengage clutch 58 (e.g., by bringing engagement members of clutch 58 into contact with one another, by bringing engagement members of clutch 58 into contact with a housing of clutch 58, etc.). When engaged, clutch 58 couples (e.g., rotationally couples) first hydraulic pump 64 and second hydraulic pump 68 with an engine (e.g., by way of a transmission and a power takeoff unit, etc.). Decreasing the pump stroke before sending the second command signal reduces wear on clutch 58 (e.g., reduces wear on clutch discs of clutch 58). In one embodiment, decreasing the pump stroke decreases the pump load on clutch 58, which may be measured in units of GPM*PSI, and reduces the damaging effects associated with forcibly rubbing the engagement members (e.g., clutch discs) of clutch 58 against one another or against a housing. Accordingly, decreasing the load before engaging or disengaging clutch 58 prolongs the working life of clutch 58 relative to traditional systems.

Controller 130 may be configured to generate the first command signal to destroke at least one of first hydraulic pump 64 and second hydraulic pump 68 and thereafter generate a second command signal to engage clutch 58. Decreasing the pump stroke before sending the second command signal reduces wear on clutch 58 (e.g., reduces wear on clutch discs of clutch 58). In one embodiment, the second command signal is configured to change the state of clutch 58 (e.g., from engaged to disengaged, from disengaged to engaged, etc.).

According to an exemplary embodiment, a speed sensor is positioned to monitor a speed (e.g., a rotational speed) of an engine. By way of example, the speed of the engine may be measured in revolutions per minute. The speed of the engine affects the wear that occurs on various components of hydraulic system 60 (e.g., first hydraulic pump 64, second hydraulic pump 68, etc.). In one embodiment, controller 130 is configured to generate the first command signal (e.g., to destroke at least one of first hydraulic pump 64 and second hydraulic pump 68, etc.) when the speed of the engine exceeds a first threshold. Controller 130 may completely destroke at least one of first hydraulic pump 64 and second hydraulic pump 68 when the speed of the engine exceeds the first threshold (i.e., reduce the pump stroke to zero). By way of example, the first threshold may be 1,400 revolutions per minute. In one embodiment, controller 130 thereafter generates the second command signal to engage or disengage clutch 58 when the speed of the engine exceeds a second threshold. The second threshold may be equal to or greater than the first threshold. By way of example, the second threshold may be may be 1,400 revolutions per minute or 1,500 revolutions per minute, among other potential threshold settings.

The speed of the engine may exceed the first threshold as the vehicle enters a transportation mode (e.g., to drive down a street at various operating speeds). In one embodiment, controller 130 is configured to reduce the pump stroke and disengage clutch 58, thereby decoupling first hydraulic pump 64 and second hydraulic pump 68 from the engine, as the vehicle enters the transportation mode. In the transportation mode, the engine operates at higher speeds to power a vehicle drive system and move the vehicle. Controller 130 reduces or eliminates high speed rotation of first hydraulic pump 64 and second hydraulic pump 68 by decoupling them from the high speed rotation of the engine, thereby reducing wear on first hydraulic pump 64 and second hydraulic pump 68.

In another embodiment, controller 130 sends command signals to begin destroking at least one of first hydraulic pump 64 and second hydraulic pump 68 when the speed of the engine exceeds the first threshold. By way of example, controller 130 may send command signals to decrease the pump stroke as a function of the speed of the engine (e.g., linearly, etc.) until the pump stroke is reduced (e.g., zero) at a second threshold. According to an exemplary embodiment, controller 130 is configured to generate the second command signal (e.g., to disengage clutch 58) when the speed of the engine exceeds the second threshold.

According to an exemplary embodiment, controller 130 is configured to generate a third command signal to engage clutch 58 when the speed of the engine falls below a third threshold. In one embodiment, the third threshold is less than the second threshold. By way of example, the third threshold may be 900 revolutions per minute. The difference between the second threshold and the third threshold defines a deadband region, according to one embodiment. The deadband region reduces the risk of engaging and disengaging clutch 58 when the speed of the engine hovers at or around the second threshold, according to an exemplary embodiment.

Figure 5:
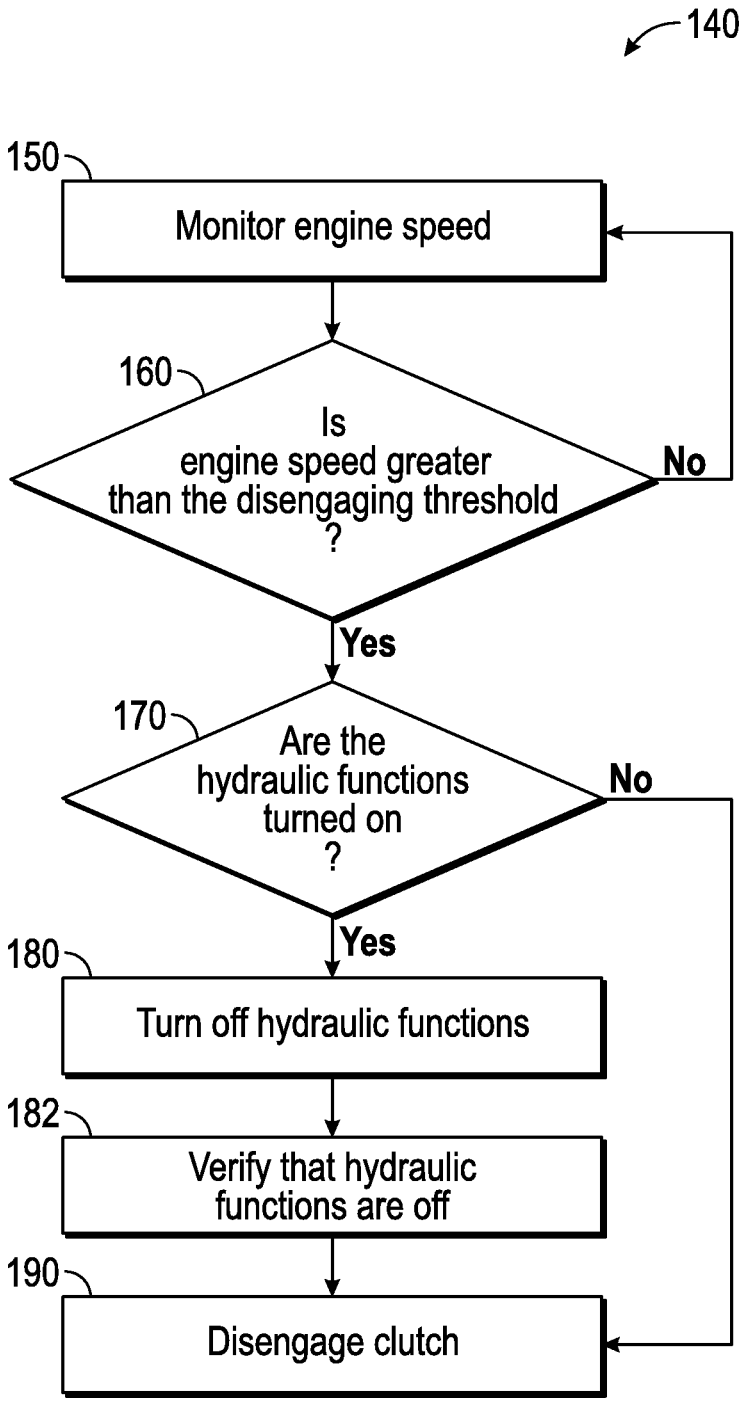
FIGS. 5-6 are flow diagrams of methods for engaging and disengaging a clutch to selectively power a hydraulic system of a vehicle, according to an exemplary embodiment.

Referring next to FIG. 5, method 140 for operating a hydraulic system for a vehicle includes monitoring a speed of the engine (150) and evaluating whether the engine speed is greater than a disengaging threshold (160). In one embodiment, the disengaging threshold is an engine speed at which the vehicle enters a transport mode. By way of example, the disengaging speed may be the first threshold or the second threshold, among others. Where the speed is not above the disengaging threshold, the vehicle may be performing a hydraulic operation (e.g., loading refuse, packing refuse, etc.). Method 140 includes continuing to monitor the speed of the engine while the engine speed is not greater than the disengaging threshold. Where the speed is above the disengaging threshold, method 140 includes determining whether the hydraulic functions are turned on (170). By way of example, step 170 may include at least one of determining whether one or more main valves and load valves are activated or deactivated and evaluating whether a hydraulic pump is stroked or destroked, among other alternatives. Where the hydraulic functions are turned on, method 140 includes turning off the hydraulic functions (180). By way of example, turning off the hydraulic functions may include at least one of destroking a hydraulic pump (e.g., by deactivating a main valve, by deactivating a load valve, etc.), among other alternatives.

According to the embodiment shown in FIG. 5, method 140 also includes verifying that the hydraulic functions are off (182). By way of example, a sensor (e.g., a pressure sensor, a linear position sensor, etc.) may be positioned to monitor whether the hydraulic functions are off. In one embodiment, a pressure sensor is positioned in a pressure line between the hydraulic pump and a main valve or in a load sensing line and provides sensing signals. By way of another example, a position sensor (e.g., a linear position sensor) may be coupled to the hydraulic pump and provide sensing signals relating to an orientation of a swash plate. Step 182 includes evaluating sensing signals from the sensor to verify that the hydraulic functions are off. In other embodiments, method 140 does not include step 182. As shown in FIG. 5, method 140 includes disengaging a clutch (190) after turning off the hydraulic functions (180). The clutch may selectively couple an engine with a hydraulic system of the vehicle (e.g., with a hydraulic pump). In other embodiments where the hydraulic functions are not turned on, method 140 includes disengaging a clutch (190) after determining that the hydraulic functions are not turned on (170). In still other embodiments, method 140 does not include step 170.

Figure 6:
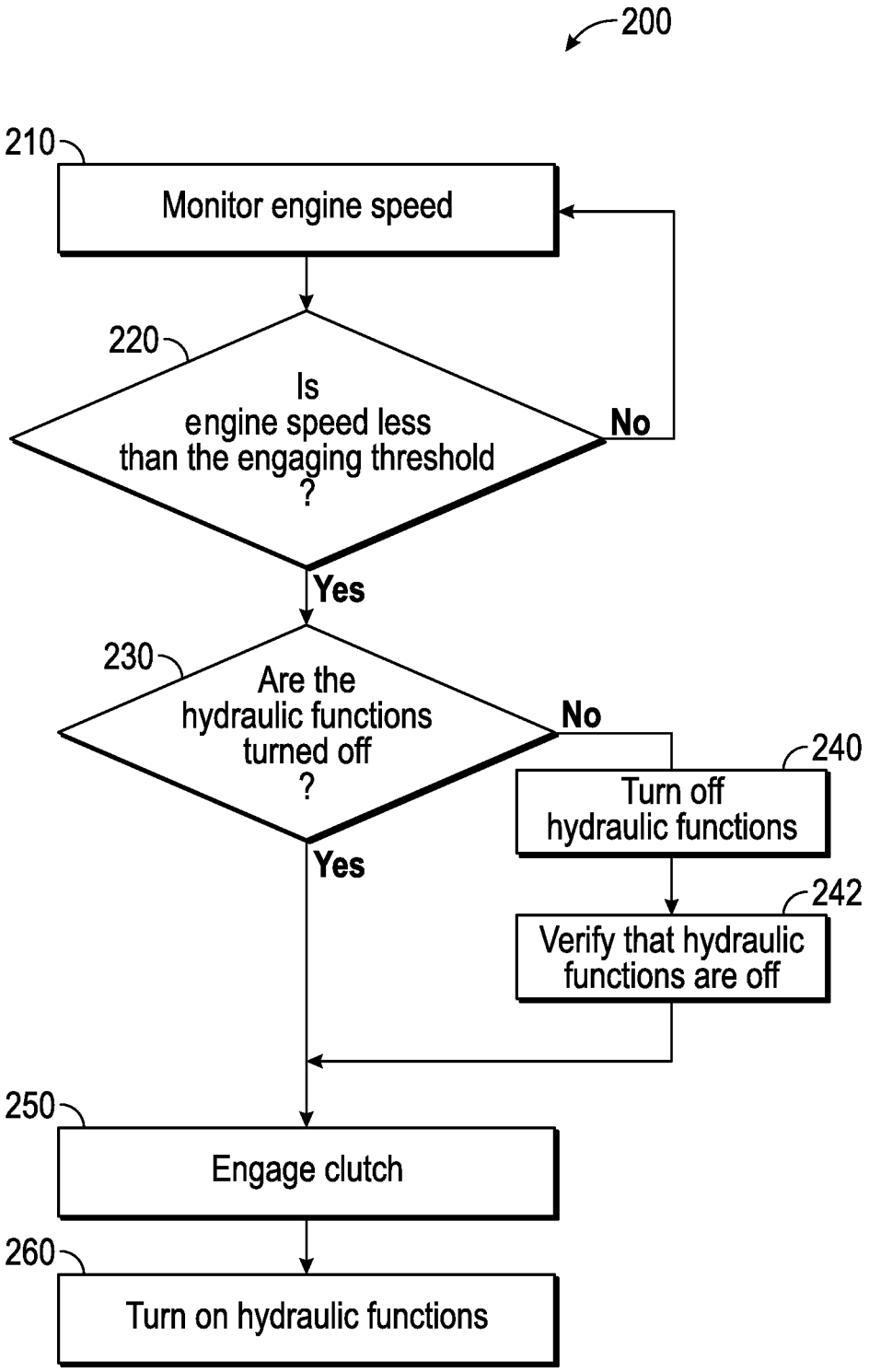

Referring next to FIG. 6, method 200 for operating a hydraulic system for a vehicle includes monitoring a speed of the engine (210) and evaluating whether the engine speed is less than an engaging threshold (220). The speed of the engine may fall below the engaging threshold as the vehicle transitions from a transport mode to a collection mode (e.g., as the vehicle slows down to collect refuse). In one embodiment, the engaging threshold is the third threshold (e.g., 900 revolutions per minute). Method 200 includes continuing to monitor the speed of the engine while the engine speed is not less than the engaging threshold. Where the speed is less than the engaging threshold, method 200 includes determining whether the hydraulic functions are turned off (230). Where the hydraulic functions are turned on, method 200 includes turning off the hydraulic functions (240) and verifying that the hydraulic functions are off (242). Where the hydraulic functions were turned off from step 230 or after verifying that the functions are off in step 242, method 200 includes engaging a clutch (250) and turning on the hydraulic functions (260). In other embodiments, method 200 does not include step 242. In still other embodiments, method 200 does not include step 230 and instead engages the clutch once the engine speed falls below the engaging threshold.

Figure 7:
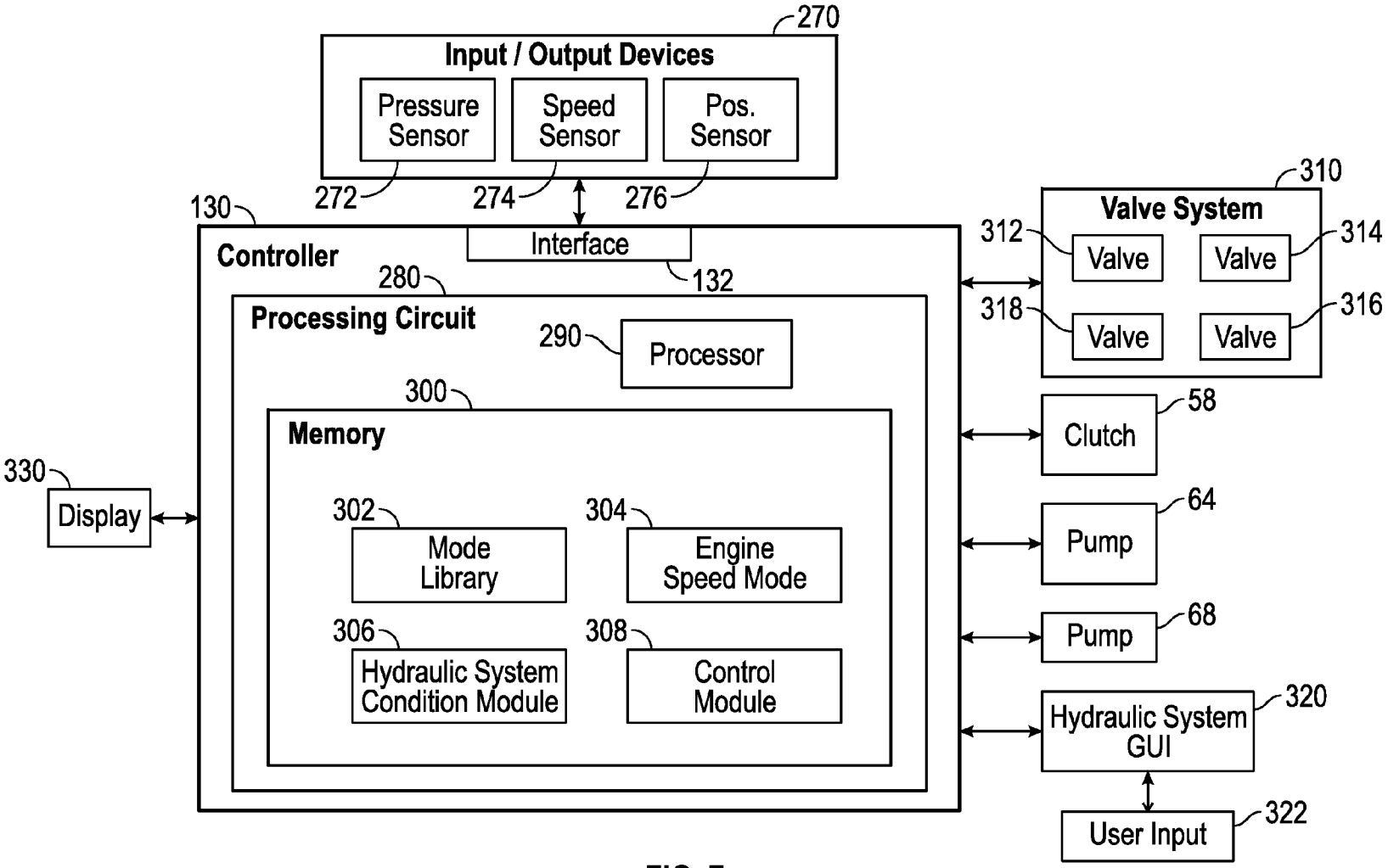
FIG. 7 is a block diagram of a hydraulic control system for a vehicle, according to an exemplary embodiment.

Referring next to the block diagram shown in FIG. 7, controller 130 engages various systems and devices to facilitate operation of a vehicle. Controller 130 receives input from one or more sensors 270. Sensors 270 may be configured to evaluate a pressure, speed, or position and provide sensing signals to be analyzed by controller 130. As shown in FIG. 7, sensors 270 include a pressure sensor 272, a speed sensor 274, and a position sensor 276. In other embodiments, sensors 370 include at least one of pressure sensor 272, speed sensor 274, and position sensor 276.

According to the exemplary embodiment shown in FIG. 7, controller 130 includes an interface, shown as interface 132. Interface 132 may include hardware to receive data, sensing signals, or other information from a network or a serial bus and to communicate data to another processing circuit via a network or a serial bus. Interface 132 may be configured to receive or transmit data wirelessly or over a hard-wired connection. As shown in FIG. 7, controller 130 communicates with sensors 270 across interface 132.

As shown in FIG. 7, controller 130 includes a processing circuit 280 having a processor 290 and a memory 300. Processor 290 may include one or more microprocessors, application specific integrated circuits (ASICs), circuits containing one or more processing components, circuitry for supporting a microprocessor, or other hardware configured for processing. In some embodiments, processor 290 is configured to execute computer code stored in memory 300 to facilitate the activities described herein. Memory 300 may be any volatile or non-volatile computer-readable storage medium capable of storing data or computer code relating to the activities described herein. As shown in FIG. 7, memory 300 is shown to include modules having computer code modules (e.g., executable code, object code, source code, script code, machine code, etc.) configured for execution by processor 290. In some embodiments, processing circuit 280 represents a collection of processing devices (e.g., servers, data centers, etc.). In such cases, processor 290 represents the collective processors of the devices and memory 300 represents the collective storage devices of the devices.

Referring still to the exemplary embodiment shown in FIG. 7, memory 300 includes a mode library 302, an engine speed module 304, a hydraulic system condition module 306, and a control module 308. Mode library 302 may include data relating to the operation of a vehicle (e.g., a refuse truck) for a transport mode and another operating mode (e.g., a collection mode). In one embodiment, the data relates to a first threshold, a second threshold, a third threshold, conditions at which the vehicle enters or exits the various operating modes, and still other data. In another embodiment, the data relates to a deadband speed range between which controller 130 does not turn on or off the hydraulic system and engage or disengage the clutch.

According to an exemplary embodiment, engine speed module 304 is configured to use data from sensors 270 and evaluate a current speed of an engine. By way of example, engine speed module 304 may use data from speed sensor 274. Hydraulic system condition module 306 may use data from at least one of pressure sensor 272 and position sensor 276 to evaluate a current condition (e.g., on, off, etc.) of the hydraulic system for the vehicle (e.g., hydraulic system 60). In one embodiment, control module 308 is configured to use the current condition of the hydraulic system evaluated by hydraulic system condition module 306, the speed of the engine evaluated by engine speed module 304, and the threshold conditions stored in mode library 302. Control module 308 may trigger a first command signal (e.g., after the engine speed exceeds a first threshold) to decrease the pump stroke of first hydraulic pump 64 and second hydraulic pump 68 and thereafter trigger a second command signal to disengage clutch 58 (e.g., at the same or a greater engine speed). Command module 308 may trigger a single command signal configured to decrease the pump stroke of first hydraulic pump 64 and second hydraulic pump 68 or may trigger a plurality of command signals associated with first hydraulic pump 64 and second hydraulic pump 68, according to various embodiments. Control module 308 may trigger a third command signal to engage clutch 58 (e.g., after the engine speed falls below a third threshold). As shown in FIG. 7, controller 130 is coupled to a valve system 310. Valve system 310 includes load valves, shown as valve 312 and valve 314, and main valves, shown as valve 316 and valve 318. Controller 130 engages and disengages valves of valve system 310 to increase and decrease the stroke of first hydraulic pump 64 and second hydraulic pump 68, according to an exemplary embodiment. The hydraulic system for the vehicle may include still other valves that may be engaged and disengaged with control signals from controller 130. In other embodiment, controller 130 increases and decreases the stroke of first hydraulic pump 64 and second hydraulic pump 68 by generating signals to actuate swash plates thereof directly (e.g., with an actuator).

According to the exemplary embodiment shown in FIG. 7, controller 130 is coupled to a hydraulic system graphical user interface (lift device GUI) 320. Hydraulic system GUI 320 may be configured to receive a user input 322 related to the functionality of the hydraulic system. Hydraulic system GUI 320 may be any type of user interface. For example, hydraulic system GUI 320 may include an LCD configured to display a current operating mode, a pump stroke, a condition of valve system 310, or still other conditions, may include one or more pushbuttons, knobs, or other input devices, may include a touchscreen, and may include still other devices. User input 322 may be a user input related to hydraulic system functionality. By way of example, user input 322 may be provided via hydraulic system GUI 320 indicating a desired threshold speed at which controller 130 turns on or off the hydraulic system.

As shown in FIG. 7, controller 130 is coupled to display 330. Display 330 may be a display positioned within a cab of the vehicle (e.g., refuse truck). Display 330 is configured to provide an operator of the vehicle with information, according to an exemplary embodiment. By way of example, display 330 may be configured to display a current operating mode, a current pump stroke, or one or more threshold speeds used by controller 130, among other information. In one embodiment, display 330 is a driver aid that shows information (e.g., a current operating mode, etc.) to an operator, thereby facilitating use of the vehicle.

The present disclosure contemplates methods, systems, and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data, which cause a general purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

It is important to note that the construction and arrangement of the elements of the systems and methods as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the components described herein may be constructed from any of a wide variety of materials that provide sufficient strength or durability, in any of a wide variety of colors, textures, and combinations. Accordingly, all such modifications are intended to be included within the scope of the present inventions. Other substitutions, modifications, changes, and omissions may be made in the design, operating conditions, and arrangement of the preferred and other exemplary embodiments without departing from scope of the present disclosure or from the spirit of the appended claims.

What is claimed is:

1. A hydraulic system for a vehicle, comprising:

a variable displacement pump configured to pressurize a fluid based on a pump stroke, wherein the variable displacement pump includes an output, a swash plate, and a feedback valve positioned to control an orientation of the swash plate, and wherein the pump stroke varies based on the orientation of the swash plate;

a clutch positioned to selectively couple the variable displacement pump with an engine when engaged and selectively decouple the variable displacement pump from the engine when disengaged;

an actuator coupled to the output of the variable displacement pump with a pressure line;

a main valve disposed along the pressure line;

a load sensing line coupling the main valve to the feedback valve of the variable displacement pump;

a load valve disposed along the load sensing line, wherein the load valve includes a movable element configured to limit flow from the main valve to the feedback valve when disengaged; and a controller coupled to the variable displacement pump and the clutch, wherein the controller is configured to generate a first command signal to disengage the load valve and thereby decrease the pump stroke and thereafter generate a second command signal to disengage the clutch.

2. A hydraulic system for a vehicle, comprising:

a variable displacement pump configured to pressurize a fluid based on a pump stroke, wherein the variable displacement pump includes an output, a swash plate, and a feedback valve positioned to control an orientation of the swash plate, and wherein the pump stroke varies based on the orientation of the swash plate;

a clutch positioned to selectively couple the variable displacement pump with an engine when engaged and selectively decouple the variable displacement pump from the engine when disengaged;

an actuator coupled to the output of the variable displacement pump with a pressure line;

a load sensing line coupling the main valve to the feedback valve of the variable displacement pump;

a main valve disposed along the pressure line, wherein the main valve includes a movable element configured to limit flow from the variable displacement pump to the actuator and the load sensing line when disengaged; and a controller coupled to the variable displacement pump and the clutch, wherein the controller is configured to generate a first command signal to disengage the main valve and thereby decrease the pump stroke and thereafter generate a second command signal to disengage the clutch.

3. The hydraulic system of claim 2, further comprising a speed sensor positioned to monitor a speed of the engine.

4. The hydraulic system of claim 3, wherein the controller is configured to generate the first command signal when the speed of the engine exceeds a first threshold.

5. The hydraulic system of claim 4, wherein the controller is configured to generate the second command signal when the speed of the engine exceeds a second threshold.

6. The hydraulic system of claim 5, wherein the controller is configured to generate a third command signal to engage the clutch when the speed of the engine falls below a third threshold.

7. A hydraulic system for a vehicle, comprising:

a variable displacement pump configured to pressurize a fluid based on a pump stroke, wherein the variable displacement pump includes an output, a swash plate, and a feedback valve positioned to control an orientation of the swash plate, and wherein the pump stroke varies based on the orientation of the swash plate;

a clutch positioned to selectively couple the variable displacement pump with an engine when engaged and selectively decouple the variable displacement pump from the engine when disengaged;

an actuator coupled to the output of the variable displacement pump with a pressure line;

a load sensing line coupling the main valve to the feedback valve of the variable displacement pump;

a main valve disposed along the pressure line, wherein the main valve includes a movable element configured to limit flow from the variable displacement pump to the actuator and the load sensing line when disengaged;

a load valve disposed along the load sensing line, wherein the load valve includes a movable element configured limit flow from the main valve to the feedback valve when disengaged; and a controller coupled to the variable displacement pump and the clutch, wherein the controller is configured to generate a first command signal to disengage the main valve and the load valve and thereby decrease the pump stroke and thereafter generate a second command signal to disengage the clutch.

8. The hydraulic system of claim 1, further comprising a speed sensor positioned to monitor a speed of the engine.

9. The hydraulic system of claim 8, wherein the controller is configured to generate the first command signal when the speed of the engine exceeds a first threshold.

10. The hydraulic system of claim 9, wherein the controller is configured to generate the second command signal when the speed of the engine exceeds a second threshold.

11. The hydraulic system of claim 10, wherein the controller is configured to generate a third command signal to engage the clutch when the speed of the engine falls below a third threshold.

12. The hydraulic system of claim 3, further comprising a speed sensor positioned to monitor a speed of the engine.

13. The hydraulic system of claim 12, wherein the controller is configured to generate the first command signal when the speed of the engine exceeds a first threshold.

14. The hydraulic system of claim 13, wherein the controller is configured to generate the second command signal when the speed of the engine exceeds a second threshold.

15. The hydraulic system of claim 14, wherein the controller is configured to generate a third command signal to engage the clutch when the speed of the engine falls below a third threshold.

* * * * *